US005923916A

United States Patent [19]

Piccinino, Jr. et al.

[11] Patent Number: 5,923,916

[45] Date of Patent: Jul. 13, 1999

[54] PROCESSING ASSEMBLY HAVING A PROCESSING APPARATUS WITH AN INCLINED PROCESSING PATH

[75] Inventors: Ralph L. Piccinino, Jr., Rush, N.Y.; Anthony Earle, Harrow; Leslie R. Wells, Brentford, both of United Kingdom

[73] Assignee: Eastman Kodak Company, Rochester, N.Y.

[21] Appl. No.: 08/947,688

[22] Filed: Oct. 9, 1997

[51] Int. Cl.[6] ..... G03D 3/02

[52] U.S. Cl. ..... 396/626; 396/630; 396/636; 396/627; 396/620

[58] Field of Search ..... 396/612, 615, 396/620, 626, 627, 630

[56] References Cited

U.S. PATENT DOCUMENTS 4,371,250 2/1983 Wakabayashi et al. ..... 396/627

5,311,235 5/1994 Piccinino, Jr. et al. ..... 396/618

5,579,076 11/1996 Calisto et al. ..... 396/627

5,669,035 9/1997 Kurematsu et al. ..... 396/626

*Primary Examiner*—D. Rutledge

*Attorney, Agent, or Firm*—David A. Novais; Frank Pincelli

[57] ABSTRACT

A processing apparatus for processing photosensitive material combines thin channel technology with nozzles, and an inclined processing path. Processing solution can be introduced into the inclined processing path so as to cause the solution to flow along the inclined processing path in a direction which is opposite to a direction of travel of the photosensitive material in the inclined processing path. With the arrangement of the present invention, photosensitive material can be processed in the first processing path by way of the nozzle spray arrangement and can be subjected to further processing along the inclined processing path.

15 Claims, 2 Drawing Sheets

PROCESSING ASSEMBLY HAVING A PROCESSING APPARATUS WITH AN INCLINED PROCESSING PATH

FIELD OF THE INVENTION

The present invention relates to a photosensitive material processing assembly which processes photosensitive material.

BACKGROUND OF THE INVENTION

The processing of photographic film involves a series of steps such as developing, bleaching, fixing, washing and drying. In the process, a continuous web of film or cut sheet of film or photographic paper are sequentially conveyed through a series of stations or tanks with each one containing a different processing liquid appropriate to the process step at that station. In conventional processing assemblies, three wash tanks are used for washing film and four wash tanks are used for paper. Conventional processing assemblies have drawbacks in that they require a large amount of space and equipment which leads to increased costs.

SUMMARY OF THE INVENTION

The present invention provides for a processing assembly which comprises a processing apparatus that can replace the three wash tanks for film and four wash tanks for paper of conventional arrangements. The processing apparatus includes a nozzle spray arrangement along a first processing path and an inclined second processing path which extends from the first processing path. The inclined processing path is substantially sealed from the atmosphere and includes a plurality of overflow processing sections along the length of the inclined processing path. Each of the overflow processing sections includes a tray-like arrangement which receives overflow processing solution from an adjacent overflow processing section the inclined processing path. The arrangement of the present invention combines a thin-channel nozzle design with the benefits of a clean wash cascading fluid counter flow along the inclined processing path.

The present invention provides for a processing assembly for processing photosensitive material. The processing assembly comprises a processing apparatus having a first section with a first processing path for photosensitive material. The first processing path comprises a plurality of nozzles which apply processing solution to the photosensitive material. The processing apparatus further comprises a second section which includes an inlet in communication with an exit of the first section. The second section comprises a second processing path that extends from the inlet of the second section to an outlet of the second section for passage of the photosensitive material. The second processing path is upwardly inclined at an angle from the inlet to the outlet of the second section and comprises a plurality of overflow processing sections along a length of the second processing path. Each of the overflow processing sections comprising a first part for guiding the photosensitive material along the inclined second processing path and a second part which extends from the first part and can retain a processing solution therein. The second part comprises a first roller of a conveying roller assembly positioned therein, wherein the conveying roller assembly upwardly conveys the photosensitive material along the second processing path from the inlet to the outlet of the second section. The processing solution is supplied from a vicinity of the outlet of the second section to cause the processing solution to cascade in a downward direction along the inclined second processing path, such that the processing solution is guided along the first part into the second part to cause the processing solution to overflow the second part and to flow along an adjacent first part of adjacent overflow processing section.

The present invention also relates to a processing apparatus for use in a processing assembly for processing photosensitive material. The processing apparatus comprises a first section having an entrance and an exit and a first processing path extending therebetween for passage of the photosensitive material. The first section comprises a plurality of nozzles along the first processing path for applying solution to the photosensitive material. The processing apparatus further comprises a second section having an inlet and an outlet and a second processing path extending therebetween for passage of the photosensitive material. The second processing path has an upward incline from the inlet to the outlet of the second section. The inlet of the second section receives the photosensitive material which leaves the exit of the first section. The second section comprises a first member having a plurality of openings along the processing path and guiding surfaces disposed between the openings, such that solution introduced into the second processing path from a vicinity of the outlet of the second section will flow down the second processing path from the outlet to the inlet of the second section. The solution flowing down the second processing path is also guided by each of the guiding surfaces into a corresponding opening so as to overflow from the opening.

The present invention also provides for a method of processing photosensitive material. The method comprises the steps of introducing a photosensitive material into a first processing path of a processing apparatus; conveying the photosensitive material along the first processing path; applying processing solution to the photosensitive material as the photosensitive material is conveyed through the first processing path; conveying the photosensitive material from the first processing path to a second processing path, with the second processing path being inclined in a conveying direction of the photosensitive material, and the second processing path having a plurality of openings and guiding surfaces between the openings; and introducing processing solution into the second processing path in a direction which is opposite the conveying direction of the photosensitive material as the photosensitive material is conveyed along the second processing path, wherein the photosensitive material is processed by a flow of the solution in the second processing path and an overflow of the solution from the openings along the second processing path.

The present invention also relates to a processing assembly for processing photosensitive material. The processing assembly comprises a processing apparatus that includes a first part having a first processing path and an applying member at the first processing path for applying a solution to photosensitive material in the first processing path. The processing apparatus further comprises a second part having a second processing path which extends from the first processing path at an angle. The second part further includes a port for introducing solution to the second processing path so that the solution flows along the second processing path in a direction opposite to a direction of travel of the photosensitive material in the second processing path.

DETAILED DESCRIPTION OF THE INVENTION

Figure 1:
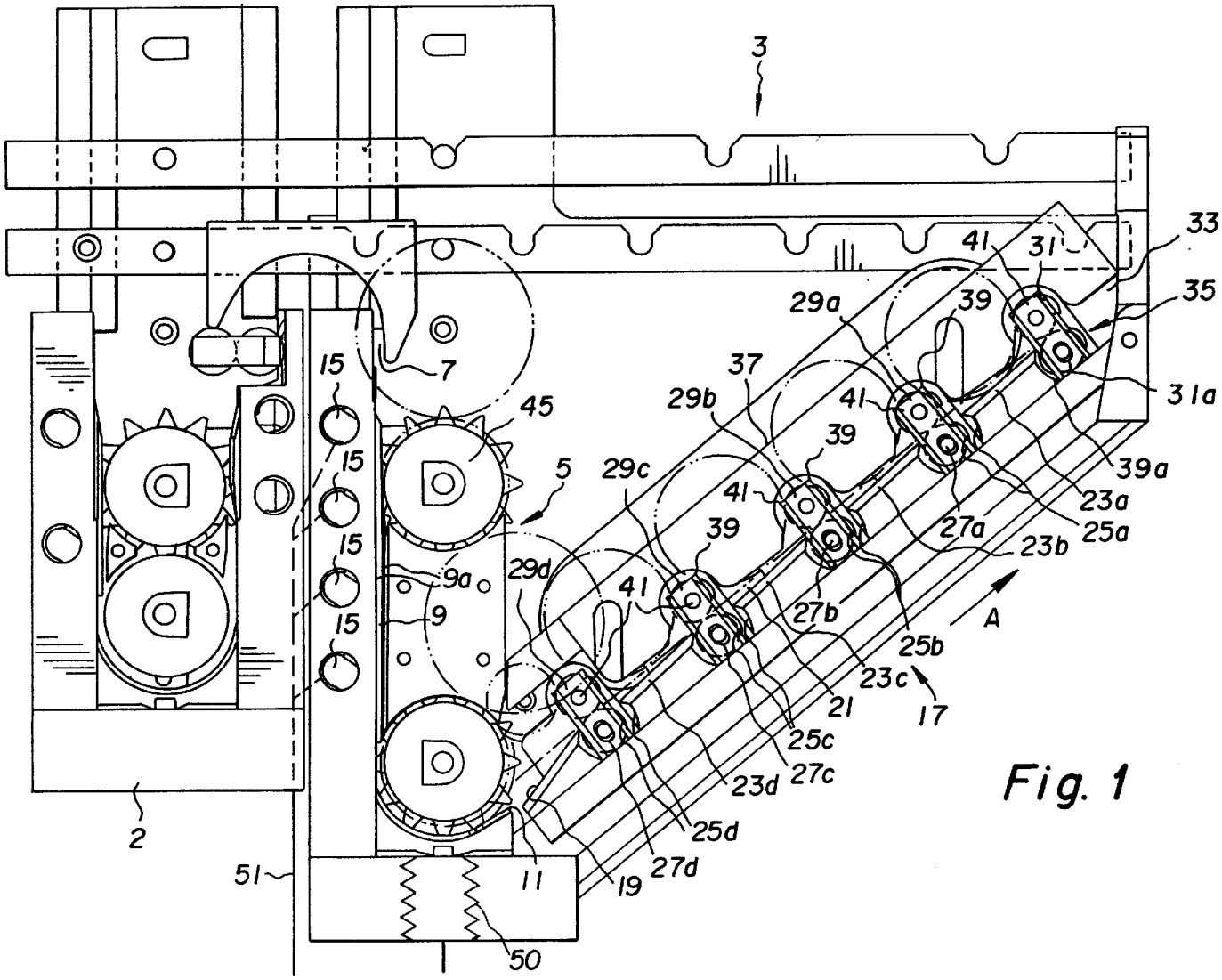
FIG. 1 illustrates an overview of the apparatus of the present invention.

Referring now to the drawings, wherein like reference numerals designate identical or corresponding parts throughout the several views, FIG. 1 illustrates a processing apparatus 3 of the present invention which can be, for example, a wash tank, and can be positioned after the last processing tank 2 of a processing assembly. It is recognized that the processing apparatus can also be, for example, a developing tank, a bleaching tank or a fixing tank. The processing assembly could include a series of processing tanks which can contain processing solutions, such as developing solution, bleaching solution, fixing solution and washing solution therein. The processing tanks can be of a rack-and-tank arrangement such as disclosed in U.S. Pat. No. 5,311,235, the subject matter of which is herein incorporated by reference.

Processing apparatus 3 includes a first section 5 which includes an inlet 7 at the top portion of first section 5 through which photosensitive material enters and passes through a first processing path 9 which can be a thin channel. First processing path 9 extends to an exit 11 at a lower portion of first section 5. Along first processing path 9 of first section 5 are disposed a plurality of nozzles 15 which spray processing solution onto the photosensitive material as it is conveyed downwardly along first processing path 9 of first section 5.

Processing apparatus 3 further includes a second section 17 which has an inlet 19 in communication with exit 11 of first section 5. Second section 17 includes an inclined second processing path 21 which comprises a plurality of guiding surfaces 23*a*–23*d* for guiding the photosensitive material upward along the inclined processing path, and curved surfaces 25*a*–25*d* in the form of trays or pans which receive a first roller 27*a*–27*d* of a conveying roller assembly 29*a*–29*d* as sell as a surface 9*a* of processing path 9. Processing paths 9 and 17 form an approximately V-shaped arrangement to provide for a compact structure.

Figure 2A:
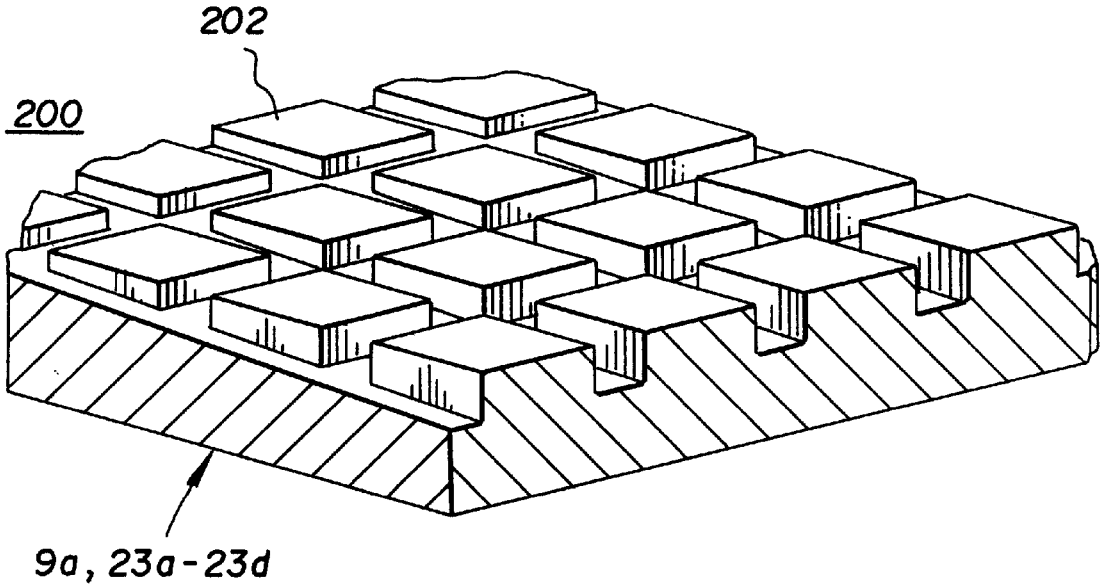
FIGS. 2A and 2B illustrate examples of textured surfaces of the guide surfaces of the present invention.
Figure 2B:
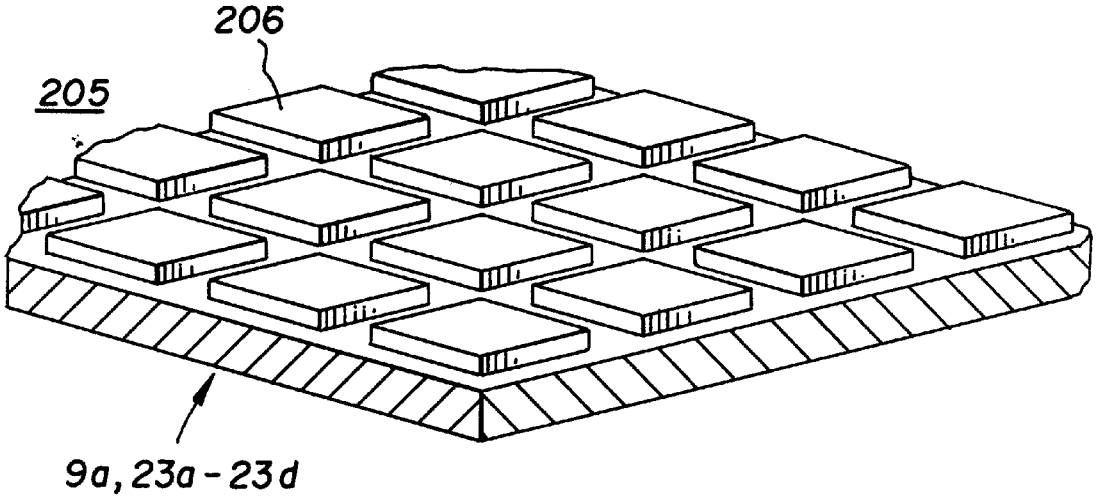

FIG. 2A and 2B are perspective drawings of textured fluid-bearing surfaces 200 and 205 which can be located on guiding surfaces 23*a*–23*d* as well as one or both surfaces 9*a* of processing path 9. Textured surfaces 200 and 205 are textured by any known process, e.g., knurling, molded, EDM electro-discharged machined or applied. Knurls 202 or 206 are respectively shown on surfaces 200 and 205. The texturing (FIGS. 2A,2B) and cantering (FIG. 2A) improve the flow of processing solution between the photosensitive material and guiding surfaces 23*a*–23*d* as well as the one or both surfaces 9*a* of processing path 9, and prevent the photosensitive material from sticking on the surfaces.

Also shown in FIG. 1 is a conveying roller assembly 31 in the vicinity of an outlet 33 of second section 17. The conveying roller assembly includes a first roller 31*a* in curved portion 39*a*. Positioned in the vicinity of outlet 33 is a supply entry port 35 for introducing solution into inclined second processing path 21. Guiding surfaces 23*a*–23*d* lead the solution cascading or flowing downward along inclined second processing path 21 into curved surfaces 25*a*–25*d* which hold the one roller 27*a*–27*d* of conveying roller assembly 29*a*–29*d*.

Second section 17 of apparatus 3 also includes an opposing member or cover 37 that includes cover portions 39 along inclined second processing path 21 that correspond to curved surfaces 25*a*–25*d*. Cover portions 39 cover an opposing roller 41 of conveying roller assembly 29*a*–29*d* and 31 with the photosensitive material passing between both rollers. With this arrangement, second inclined processing path 21 is substantially air tight so as to prevent any damage to the photosensitive material or the equipment within apparatus 3.

During use of apparatus 3 of the present invention, photosensitive material which exits last processing tank 2 of a processor enters into first section 5 of apparatus 3 through the entrance 7. First section 5 of apparatus 3 includes conveying rollers 45 which convey the photosensitive material through first processing path 9 of first section 5. First processing path 9 is generally vertical and includes nozzles 15 along its length. Nozzles 15 apply processing solution, for example, washing solution to the photosensitive material as it passes through first processing path 9. The photosensitive material exits first section 5 through exit 11 at the lower end of first section 5, enters into inlet 19 of second section 17, and is introduced into inclined second processing path 21. Conveying roller assemblies 29*a*–29*d* and 31 of inclined second processing path 21 convey the photosensitive material in an upward direction A along inclined second processing path 21. As the photosensitive material is conveyed along inclined second processing path 21, fresh solution is supplied at entry port 35. The fresh solution overflows curved surface portion 39*a* located at outlet 33 and is guided along guiding surface 23*a* into curved surface 25*a*. The solution thereafter accumulates and overflows curved surface 25*a* and is guided by guiding surface 23*b*. This process continues for all the curved surfaces and guiding surfaces as the solution flows down the inclined second processing path 21. With this arrangement, a cascading downward solution flow which includes a series of overflow sections is created.

As illustrated in the FIG. 1, each of guiding surfaces 23*a*–23*d* can be set at an incline which is slightly greater than the incline of second processing path 21 so as to assure the upward conveyance of the photosensitive material. At the lower end of inclined second processing path 21, the solution exits second section 17 at inlet 19 of second section 17, and is collected at the bottom of first section 5.

In a wash tank application, the processing solution would be washing solution which washes the photosensitive material at it moves up inclined second processing path 21 in direction A. Each of rollers 27*a*–27*d* and 31*a* of the conveying roller assemblies which are submerged within the solution in the curved surfaces 25*a*–25*d* and 39*a*, apply washing solution to the photosensitive material and squeegee the solution on the photosensitive material to clean the photosensitive material. At the same time, the overflowing washing solution as well as the cascading washing solution also serve to clean the photosensitive material. It is recognized that the present invention is not limited to a wash tank application, and other solutions such as developing solution, bleaching solution and fixing solution could be utilized.

As noted above, the processing solution which flows down inclined second processing path 21 is collected at the lower end of the first section 5. The collected solution can drain through an outlet 50 and be recirculated by a recirculation system 51 towards nozzles 15. This permits the collected processing solution at the lower end of first section 5 to be utilized to clean the photosensitive material as it passes along first processing path 9 of first section 5.

The arrangement of the present invention permits the use of the cascading processing solution by collecting the processing solution at the lower end of first section 5 and recirculating the washing solution to nozzles 15. Also, with the arrangement of the present invention, after the photosensitive material leaves first section 5 it enters into inclined second processing path 21 so as to be subjected to processing by way of the cascading solution flow.

Therefore, in the present invention, recirculated processing solution can be applied via nozzles 15 at first section 5, and when the photosensitive material enters second section 17, fresh processing solution can be applied in a cascading manner along inclined processing path 21 via port 35. Of course, it is noted that this is only one embodiment of the present invention and depending on design considerations, fresh solution can be applied to both the first and second sections 5, 17.

Accordingly, the arrangement of the present invention provides for a processing such as cleaning of photosensitive material by use of a nozzle assembly, rollers submerged in solution, a downwardly cascading solution flow along an inclined processing path, and an overflow of solution from trays or pans caused by the flow of solution along the inclined path.

The invention has been described in detail with particular reference to certain preferred embodiments thereof, but it will be understood that variations and modifications can be effected within the spirit and scope of the invention.

What is claimed is:

1. A processing assembly for processing photosensitive material, the processing assembly comprising:

a processing apparatus having a first section with a first processing path for photosensitive material, said first processing path comprising a plurality of nozzles which supply processing solution to the photosensitive material, the processing apparatus further comprises a second section which includes an inlet in communication with an exit of said first section, said second section comprising a second processing path which extends from the inlet of said second section to an outlet of the second section for passage of the photosensitive material, said second processing path being upwardly inclined at an angle from the inlet to the outlet of the second section and comprising a plurality of overflow processing sections along a length of the second processing path, each of the overflow processing sections comprising a first part for guiding the photosensitive material along the inclined second processing path and a second part which extends from the first part and can retain processing solution therein, each of said second parts comprising a first roller of a conveying roller assembly, wherein the conveying roller assembly upwardly conveys the photosensitive material through the second processing path from the inlet to the outlet of the second section, the washing solution being supplied to the second processing path from a vicinity of the outlet of said second section to cause the processing solution to cascade in a downward inclined direction along the inclined second processing path, such that the processing solution is guided along the first part into the second part to cause the processing solution to overflow the second part and flow to an adjacent first part.

2. A processing assembly according to claim 1, wherein said first processing path is vertically disposed so as to downwardly guide said photosensitive material in a vertical direction from an entrance to the exit of the first section, said nozzles supplying processing solution to the photosensitive material as the photosensitive material is guided along the first processing path.

3. A processing assembly according to claim 1, wherein the first part and at least one surface of the first processing path comprises a textured surface, and the first part has a steeper incline than said second processing path, the second part defining a curved tray portion with the first roller of said conveying roller assembly being positioned in said curved tray portion, such that said first roller is at least partially submerged in the processing solution.

4. A processing assembly according to claim 3, wherein said second section comprises an opposing surface which is on an opposing side of the second inclined processing path than said overflow processing sections, said opposing surface comprising a plurality of cover portions which correspond to the curved tray portions and cover a second roller of said conveying roller assembly therein, said second roller opposing said first roller with the photosensitive material passing therebetween.

5. A processing assembly according to claim 2, wherein said processing solution which cascades down said second processing path enters into the first section through the exit of said first section and is collected at a lower portion of said first section, said processing apparatus further comprising a recirculation system which recirculates the collected processing solution at the lower portion of the first section to the nozzles of the first section.

6. A processing assembly according to claim 1, wherein said processing apparatus is one of a washing apparatus, a fixing apparatus, a developing apparatus and a bleaching apparatus, and said processing solution is one of a washing solution, a fixing solution, a developing solution and a bleaching solution.

7. A processing apparatus for use in a processing assembly for processing photosensitive material, the processing apparatus comprising:

a first section having an entrance and an exit and a first processing path extending therebetween for passage of the photosensitive material, said first section comprising a plurality of nozzles along the first processing path for applying solution to the photosensitive material; and a second section having an inlet and an outlet and a second processing path extending therebetween for passage of the photosensitive material, said second processing path having an upward incline from the inlet to the outlet of the second section, said inlet of the second section receiving the photosensitive material which leaves the exit of the first section, said second section comprising a first member having a plurality of openings along the second processing path and guiding surfaces disposed in between the openings, such that solution introduced into the second processing path from a vicinity of the outlet of the second section will flow down the second processing path from the outlet to the inlet of the second section, and the solution flowing down the second processing path is guided by each of the guiding surfaces into a corresponding opening so as to overflow from the opening.

8. A processing apparatus according to claim 7, wherein said first and second processing paths define an approximately V-shape.

9. A processing apparatus according to claim 7, wherein said guiding surfaces and at least one surface of said first processing path comprise a textured surface.

10. A processing apparatus according to claim 7, wherein said solution which flows down said second processing path leaves the second section through the inlet of the second section and enters a lower portion of the first section through the exit of the first section, the solution being collected at the lower portion of the first section.

11. A processing apparatus according to claim 10, further comprising a recirculation system which recirculates the solution at the lower portion of the first section to the nozzles of the first section.

12. A processing apparatus according to claim 7, wherein said inlet of the second section is adjacent to the exit of the first section.

13. A processing apparatus according to claim 7, wherein a first roller of a conveying roller assembly is positioned in each of said openings of said first member.

14. A processing apparatus according to claim 12, wherein the second section further comprises a second member which opposes said first member with the second processing path extending therebetween, said second member having opposing openings which correspond to the openings of the first member, said opposing openings of the second member comprising a second roller of the conveying roller assembly which opposes the first roller so as to permit a passage of the photosensitive material therebetween.

15. A processing apparatus according to claim 7, wherein said solution is one of a washing solution, a fixing solution, a developing solution and a bleaching solution.

* * * * *